US008176930B2

(12) United States Patent
Takagi et al.

(10) Patent No.: US 8,176,930 B2
(45) Date of Patent: May 15, 2012

(54) WATER SUPPLY APPARATUS FOR USE IN ICE MAKER

(75) Inventors: Shinya Takagi, Kashiba (JP); Yoshikazu Inoue, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 827 days.

(21) Appl. No.: 12/296,818

(22) PCT Filed: Dec. 20, 2006

(86) PCT No.: PCT/JP2006/325344

§ 371 (c)(1),
(2), (4) Date: Oct. 10, 2008

(87) PCT Pub. No.: WO2007/148423

PCT Pub. Date: Dec. 27, 2007

(65) Prior Publication Data

US 2009/0301587 A1 Dec. 10, 2009

(30) Foreign Application Priority Data

Jun. 20, 2006 (JP) ..... PCT/JP2006/312297

(51) Int. Cl.
*B67D 7/72* (2010.01)

(52) U.S. Cl. ..... 137/209; 137/216; 62/66; 62/340

(58) Field of Classification Search ..... 137/206, 137/209, 216; 62/66, 69, 340, 344, 347
See application file for complete search history.

(56) References Cited

U.S. PATENT DOCUMENTS

| | | | | |
|---|---|---|---|---|
| 1,642,321 | A * | 9/1927 | Batterman | 62/100 |
| 4,998,555 | A * | 3/1991 | Barhydt et al. | 137/359 |
| 5,176,165 | A * | 1/1993 | Traylor | 137/216.1 |
| 2004/0196326 | A1 * | 10/2004 | Sasa | 347/29 |

FOREIGN PATENT DOCUMENTS

| | | | |
|---|---|---|---|
| JP | 55-6778 | | 1/1980 |
| JP | 2735170 | B2 | 1/1998 |
| JP | 2001-183040 | A | 7/2001 |
| JP | 2004-84980 | A | 3/2004 |

* cited by examiner

*Primary Examiner* — Craig Schneider
(74) *Attorney, Agent, or Firm* — Birch, Stewart, Kolasch & Birch, LLP

(57) ABSTRACT

A water supply apparatus (1) for an automatic ice maker comprises: a water supply tank (10); an air pump (70); an air supply pipe (60); and a water supply channel, disposed between the water supply tank and an ice tray (80), for supplying water to the ice tray by using the air pump which feeds air into the water supply tank and through a pressure of the air sending the water outside of the water supply tank. The water supply channel includes a pressure adjusting chamber (40) for adjusting a pressure in the water supply channel and a water supply pipe (50) for causing the water to flow into the ice tray. The water supply pipe includes first and second water supply pipe parts (51), (52) that are attachable and detachable. The air supply pipe includes first and second air supply pipe parts (61), (62) that are attachable and detachable.

10 Claims, 8 Drawing Sheets

WATER SUPPLY APPARATUS FOR USE IN ICE MAKER

BACKGROUND OF THE INVENTION

1. Field of the Invention

The present invention relates generally to water supply apparatuses for use in ice makers and, in particular, to a water supply apparatus for use in an ice maker, which is incorporated into a refrigerator-freezer or the like.

2. Description of the Related Art

Conventionally, there has been known an ice maker which is incorporated into a refrigerator-freezer for use therein. For example, as such an ice maker, Japanese Patent No. 2735170 (Patent Document 1) discloses a configuration of an ice-making machine. This ice-making machine comprises: a water supply tank which is provided in a refrigerating room and is easily attachable and detachable; an ice tray which is disposed in a freezing room located below the refrigerating room; and a pump which causes water in a water supply tank to flow into the ice tray.

The pump employed in this ice-making machine is a gear pump. Since the gear pump is self-suction-type, the water is sucked directly from the water supply tank by rotation of a motor. In other words, the water flows from a suction tube, which is inserted into the water supply tank, passes through a pipe coupling member, and enters the pump. The water flows from the pump, passes through piping, and is discharged from a nozzle. In such a manner, the water in the water supply tank is supplied to the ice tray via the pump by positive rotation.

Upon expiry of a water supply timer, the pump is switched to negative rotation and discharging of the water from the nozzle is stopped. At this time, the ice tray has been filled with the water. The reason why after supplying the water, the pump is automatically caused to rotate in a negative manner for a given period of time by the negative rotation of the motor is in order to collect the remaining water in a water supplying channel for causing the water in the water supply tank to flow into the ice tray, in the water supply tank via the pump.

Patent Document 1: Japanese Patent No. 2735170

SUMMARY OF THE INVENTION

Problems to be Solved by the Invention

In the above-mentioned conventional ice-making machine, after the water in the water supply tank has been supplied to the ice tray by the positive rotation of the pump, the pump is caused to rotate in the negative manner so as to prevent the remaining water in the water supply tank from naturally draining into the ice tray and furthermore, so as to prevent the remaining water in the water supply tank from naturally draining into the ice tray due to a siphon phenomenon. Therefore, in the conventional ice-making machine in which the motor is rotated for a given period of time in order to supply a given amount of the water into the ice tray, it is required to control the pump so as to rotate in a negative manner each time the give amount of the water is supplied.

In addition, the water passes through an inside of the pump, whereby the water is supplied into the ice tray. Therefore, there may be a case where the passage of the water makes the inside of the pump unclean. However, it is difficult to clean the inside of the gear pump. Thus, from a hygiene point of view, the conventional ice-making machine has had room for improvement.

Furthermore, a foreign substance (including a drink ingredient such as tea and juice) mixed in the water and dirt generated from a filter or the like accumulate inside of the pump, thereby causing the pump not to work and therefore, leading to a case where the water cannot be supplied to the ice tray.

Therefore, an object of the present invention is to provide a water supply apparatus for use in an ice maker, which allows easy prevention of the natural draining of the water due to the siphon phenomenon which may occur after a water supply operation has been stopped; which enables solving the problem that the foreign substance or the like mixed in the water may cause a water supply operation to be stopped; and which comprises a further hygienic water supply mechanism.

Means for Solving the Problems

A water supply apparatus, according to the present invention, for use in an ice maker is operable to supply water to be frozen to an ice tray and comprises: a water supply tank; an air pump; an air supply pipe; and a water supply channel. The water supply tank contains water. The air pump feeds air into the water supply tank. The air supply pipe is disposed between the air pump and the water supply tank to feed the air from the air pump into the water supply tank. The water supply channel is disposed between the water supply tank and the ice tray to supply the water to the ice tray by using the air pump which feeds the air into the water supply tank through a pressure of the air sending the water from an inside of the water supply tank to an outside of the water supply tank. The water supply channel includes a pressure adjusting part for adjusting a pressure in the water supply channel and a water supply pipe for causing water to flow into the ice tray. The water supply pipe includes a first water supply pipe part disposed on a side of the pressure adjusting part and a second water supply pipe part disposed on a side of the ice tray, and the first water supply pipe part and the second water supply pipe part are attachable and detachable. In addition, the air supply pipe includes a first air supply pipe part disposed on a side of the water supply tank and a second air supply pipe part disposed on a side of the air pump, and the first air supply pipe part and the second air supply pipe part are attachable and detachable. By employing such a configuration, the water supply tank can be attached and detached together with the first water supply pipe part and the first air supply pipe part, thereby allowing the water supply tank to be easily attached to and easily detached from the ice tray.

In the water supply apparatus of the present invention for use in the ice maker, the air pump feeds the pressurized air into the water supply tank and thereby, the water is sent by the pressure of the air from the inside of the water supply tank to the outside of the water supply tank and supplied to the ice tray. Therefore, without causing the water to pass through the inside of the pump, the water can be supplied from the water supply tank to the ice tray. Thus, the problem that the passage of the water makes the inside of the pump unclean can be solved. Accordingly, the water supply apparatus of the present invention for use in the ice maker is an apparatus which comprises a more hygienic water supply mechanism than the water supply mechanism comprising the conventional gear pump.

In addition, the water supply apparatus of the present invention for use the ice maker can supply the water from the water supply tank to the ice tray without passing the water through the inside of the pump, whereby accumulation of a foreign substance mixed in the water and dirt generated from a filter or the like in the inside of the pump is not caused. Thus, a trouble that the foreign substance or the like mixed in the water causes the pump not to work and thereby, the water cannot be supplied to the ice tray does not arise. Accordingly, the problem that the foreign substance or the like mixed in the water causes the water supply to stop can be solved.

Furthermore, in the water supply apparatus of the present invention for use in the ice maker, the water supply channel is disposed between the water supply tank and the ice tray and the pressure adjusting part for adjusting the pressure, in the water supply channel, to be equal to the atmospheric pressure is included. Therefore, by employing such a configuration, even if a positional relationship between a level of the water in the water supply tank and a level of the water in the ice tray, which results when the air pump feeds the water via the water supply channel from the inside of the water supply tank to the outside of the water supply tank through the pressure of the air fed to the inside of the water supply tank and thereafter, the water supply using the air pump is stopped, is a positional relationship which causes a siphon phenomenon, the pressure adjusting part allows a part of the water supply channel to be adjusted to be under an atmospheric pressure (to be made open to an atmosphere). Therefore, an outflow of the water from the water supply tank to the ice tray due to the siphon phenomenon after the water supply using the air pump has been stopped can be easily prevented.

In the water supply apparatus of the present invention for use in the ice maker, it is preferable that the water supply channel includes a discharge pipe for causing the water in the water supply tank to flow outside of the water supply tank. In addition, it is preferable that the pressure adjusting part is disposed between an outlet of the discharge pipe and an inlet of the water supply pipe and has a structure in which circulation of gas inside and outside of the pressure adjusting part is enabled. As one example, a pressure adjusting part having an opening and as another example, a pressure adjusting part in which an inner diameter of a water supply pipe is enlarged so as to allow an inflow of the air along with the water supply can be considered.

When the air pump feeds the air into the water supply tank and thereby, sends the water through the pressure of the air via the water supply channel from the inside of the water supply tank to the outside of the water supply tank, and thereafter, the air pump is stopped, the water in the water supply channel, particularly in the water supply pipe for causing the water to flow into the ice tray, flows out, thereby generating a negative pressure in the water supply channel. This negative pressure is eliminated (adjusted to be equal to the atmospheric pressure) by an external air flowing into the pressure adjusting part. Therefore, the flow of the water in the water supply channel is interrupted between a side of the water supply pipe and a side of the discharge pipe, the water in the water supply pipe flows out into the ice tray, and the water in the discharge pipe flows back into the water supply tank. Accordingly, a configuration in which the gas can circulate between the inside and outside of the pressure adjusting enables the prevention of the outflow of the water from the water supply tank to the ice tray due to the siphon phenomenon. As one example of such a configuration, a simple configuration having an opening provided thereto can be considered.

In addition, in the water supply apparatus of the present invention for use in the ice maker, it is preferable that the pressure adjusting part is disposed above the water supply tank; the discharge pipe is a pipe for causing the water in the water supply tank to flow into the pressure adjusting part; and the water supply pipe is disposed below the pressure adjusting part and above the ice tray and is a pipe for causing the water in the pressure adjusting part to flow into the ice tray.

When the air pump feeds the pressurized air into the water supply tank and thereby, sends the water through the pressure of the air via the water supply channel from the inside of the water supply tank to the outside of the water supply tank, the water flows into the pressure adjusting part above the water supply tank through the discharge pipe, with the pressure therein adjusted to be equal to the atmospheric pressure (released open to the atmosphere). In this case, since the water supply pipe is disposed below the pressure adjusting part and above the ice tray, the water in the pressure adjusting part is caused by gravitation to flow into the ice tray through the water supply pipe. The water supply is performed in such a manner, whereby all the water which the air pump causes to flow into the pressure adjusting part via the discharge pipe can be supplied via the water supply pipe to the ice tray.

In addition, in this case, it is preferable that the pressure adjusting part includes a movable member for allowing an upper portion of an inside space thereof to be opened and closed.

By employing such a configuration, the inside of the pressure adjusting part and the inside of the discharge pipe can be easily cleaned, thereby allowing the inside of the water supply channel to be hygienically maintained.

It is preferable that the water supply tank includes a container, having an opening on an upper portion thereof, for containing the water and a covering member which is attachable such that the opening of the container is in a sealed state, and the first water supply pipe part, the discharge pipe, the first air supply pipe part, and the pressure adjusting part are provided on the covering member.

By employing such a configuration, the discharge pipe, the first water supply pipe part, and the pressure adjusting part which constitute the water supply channel as well as the first air supply pipe part for feeding the pressurized air from the air pump as the power source to the water supply tank are integrated into the covering member of the water supply tank, thereby allowing each of the members constituting the water supply apparatus to be integrally handled. Thus, attachment and detachment of the water supply tank can be facilitated and since the inside of the container of the water supply tank can be easily cleaned with the covering member detached, thereby allowing the inside of the water supply tank to be hygienically maintained. In addition, the inside of the water supply tank can be in a sealed state by using the covering member.

It is preferable that the first water supply pipe part and the second water supply pipe part are attachable and detachable in a horizontal direction. By employing such a configuration, when the water supply apparatus of the present invention for use in the ice maker is incorporated into the refrigerator-freezer or the like, the water supply tank can be easily attached and detached by moving, in backward and forward directions, the water supply tank to and from the ice tray incorporated in the refrigerator-freezer or the like In addition, it is preferable that the first water supply pipe part and the second water supply pipe part are attachable and detachable in an upward-and-downward direction. By employing such a configuration, when the water supply apparatus of the present invention for use in the ice maker is incorporated into the refrigerator-freezer or the like, not only the water supply tank can be easily attached and detached by moving, in upward-and-downward directions, the water supply tank to and from the ice tray incorporated in the refrigerator-freezer or the like but also the water supply channel can be easily cleaned.

Furthermore, it is preferable that the first water supply pipe part and the first air supply pipe part are disposed in a neighboring manner.

As described above, since the air supply pipe part and the water supply pipe part are disposed in the neighboring manner, thereby enabling the water supply tank to be easily attached to and detached from the air pump and the ice tray. Accordingly, the water supply tank can be further easily attached and detached.

In the water supply apparatus for use in the ice maker, it is preferable that the water supply channel includes a discharge pipe for causing the water in the water supply tank to flow outside of the water supply tank and a water supply pipe for causing the water to flow into the ice tray, and the pressure adjusting part is disposed between the outlet of the discharge pipe and the inlet of the water supply pipe, and an inner diameter of the discharge pipe is smaller than an inner diameter of the water supply pipe.

The air pump feeds the pressurized air into the water supply tank, whereby the water is pushed up by the pressure of the air via the discharge pipe into the pressure adjusting part on the water supply tank. The water in the pressure adjusting part is caused to flow via the water supply pipe into the ice tray. Upon finishing the water supply, when the air pump is stopped, an inflow of external air into the pressure adjusting part causes the water in the pressure adjusting part to separately flow out to a side of the water supply pipe and a side of the discharge pipe; the water in the water supply pipe is supplied to the ice tray; and the water in the discharge pipe flows back and returns into the water supply tank. At this time, an amount of the water in the discharge pipe flowing back to the water supply tank decreases in accordance with a decrease in an inner diameter of the discharge pipe. Accordingly, when the control is performed such that the given amount of the water is supplied from the water supply tank to the ice tray, the air pump is operated for the given period of time, thereby allowing prevention of a large variation in a supplied water, which is attributed to the water supply channel and particularly, to the discharge pipe. In other words, the water supply channel in the water supply apparatus of the present invention for use in the ice maker serves so as to reduce the variation in the amount of the supplied water in the control performed such that the given amount of the water is supplied from the water supply tank to the ice tray for the given period of time.

In addition, because the inner diameter of the discharge pipe is smaller than that of the water supply pipe, that is to say, the inner diameter of the water supply pipe is larger than that of the discharge pipe, an inflow of the air via the water supply pipe into the pressure adjusting part relatively increases. Therefore, an outflow of the water from the water supply tank to the ice tray due to the siphon phenomenon can be prevented also by an inflow of the external air through the water supply pipe. In other words, by making the inner diameter of the water supply pipe larger than the inner diameter of the discharge pipe, a configuration which allows the air to circulate inside and outside of the pressure adjusting part can be realized.

In the water supply apparatus of the present invention for use in the ice maker, it is preferable that a leak part for leaking the air to an outside is provided on the air supply pipe or the water supply tank.

In the water supply apparatus of the present invention for use in the ice maker, the air pump feeds the pressurized air into the water supply tank and thereby, sends the water through the pressure of the air via the water supply channel from the inside of the water supply tank to the outside of the water supply tank, whereby the water is supplied to the ice tray. Therefore, airtightness is ordinarily required in an air supply channel including the water supply tank.

However, when the water is supplied into the water supply tank, a water temperature in the water supply tank increases due to the supplied water. In addition, the water supply tank is cooled after the water has been supplied into the water supply tank, and thereby, the water temperature in the water supply tank falls. As mentioned above, the water temperature in the water supply tank changes. On the other hand, by opening the door of the refrigerator-freezer, an ambient temperature around the water supply tank may increase. As mentioned above, the ambient temperature around the water supply tank changes.

In a case where the water temperature in the water supply tank and the ambient temperature around the water supply tank change as mentioned above, a pressure in the water supply tank changes, whereby the water naturally leaks via the water supply pipe or a variation in a water amount supplied to the ice tray may occur. Accordingly, it is required to supply the water into the ice tray under an invariably constant pressure even when the pressure in the water supply tank changes due to the change in the water temperature in the water supply tank and the change in the ambient temperature around the water supply tank.

Therefore, in water supply apparatus of the present invention for use in an ice maker, a leak part for leaking the air to an outside is provided on the air supply pipe, the water supply tank, or the air pump, whereby the air supply channel which invariably communicates with the external air can be formed. This allows the pressure in the water supply tank, prior to driving the air pump, to invariably be substantially constant, whereby the water supply can be performed under the substantially constant air pressure and a water amount supplied to the ice tray can be stabilized.

In this case, it is preferable that the leak part is provided on the air supply pipe disposed in the vicinity of the air pump.

Even when the leak part is provided on the covering member or the like of the water supply tank, effect similar to above-described effect can be attained. However, it is likely that the leak part is temporarily closed due to condensation inside of the water supply tank, adhesion of the water, or the like. In order to solve this problem, the leak part is provided on the air supply pipe disposed in the vicinity of the air pump, whereby the leak part can be disposed so as not to be subject to an influence of the water. Note that it is preferable that the leak part includes a capillary tubule provided so as to branch in a substantially T-shaped manner with respect to the air supply pipe, or a small hole. In addition, when a structure which allows the air to gradually leak upon stopping the air pump is provided on the air pump itself or control which allows the air to gradually leak upon stopping the air pump is performed, the pressure in the water supply tank can be maintained to invariably be substantially constant, whereby the water supply can be performed under the substantially constant air pressure and a water amount supplied to the ice tray can be stabilized.

In addition, it is preferable that a clogging prevention part is provided at an opening of the leak part. The clogging prevention part, for example, a filter or the like is provided at the opening of the leak part, thereby allowing clogging of the opening of the leak part to be prevented.

Effect of the Invention

As described above, according to the present invention, a water supply apparatus for use in an ice maker, which comprises a further hygienic water supply mechanism, as compared with a water supply apparatus comprising the conventional gear pump, can be provided; a problem that supplying water is stopped due to a foreign substance or the like mixed in the water can be solved; and the outflow of the water from the water supply tank to the ice tray due to a siphon phenomenon after the water supply using the air pump has been stopped can be easily prevented. Moreover, the leak part is provided on the air supply pipe or the water supply tank, whereby prior to driving an air pump, a pressure in the water supply tank can be invariably substantially constant and therefore, the water can be supplied under a substantially constant air pressure, thereby allowing stabilization of a water amount supplied to the ice tray.

EXPLANATION OF REFERENCE NUMERALS

1, 2: water supply apparatus for use in an automatic ice maker, 10: water supply tank, 20: water supply tank top cover, 30: discharge pipe, 40: pressure adjusting chamber, 41: top lid, 42: small vent, 50: water supply pipe, 51: water supply pipe joint A, 52: water supply pipe joint B, 53: water supply pipe joint C, 54: water supply pipe joint D, 60: air supply pipe, 61: air supply pipe joint A, 62: air supply pipe joint B, 63: air supply pipe joint C, 64: air supply pipe joint D, 70: air pump, 80: ice tray, 91: leak part, 92: clogging prevention part.

DETAILED DESCRIPTION OF THE INVENTION

Hereinafter, an embodiment of the present invention will be described with reference to the drawings.

Figure 1:
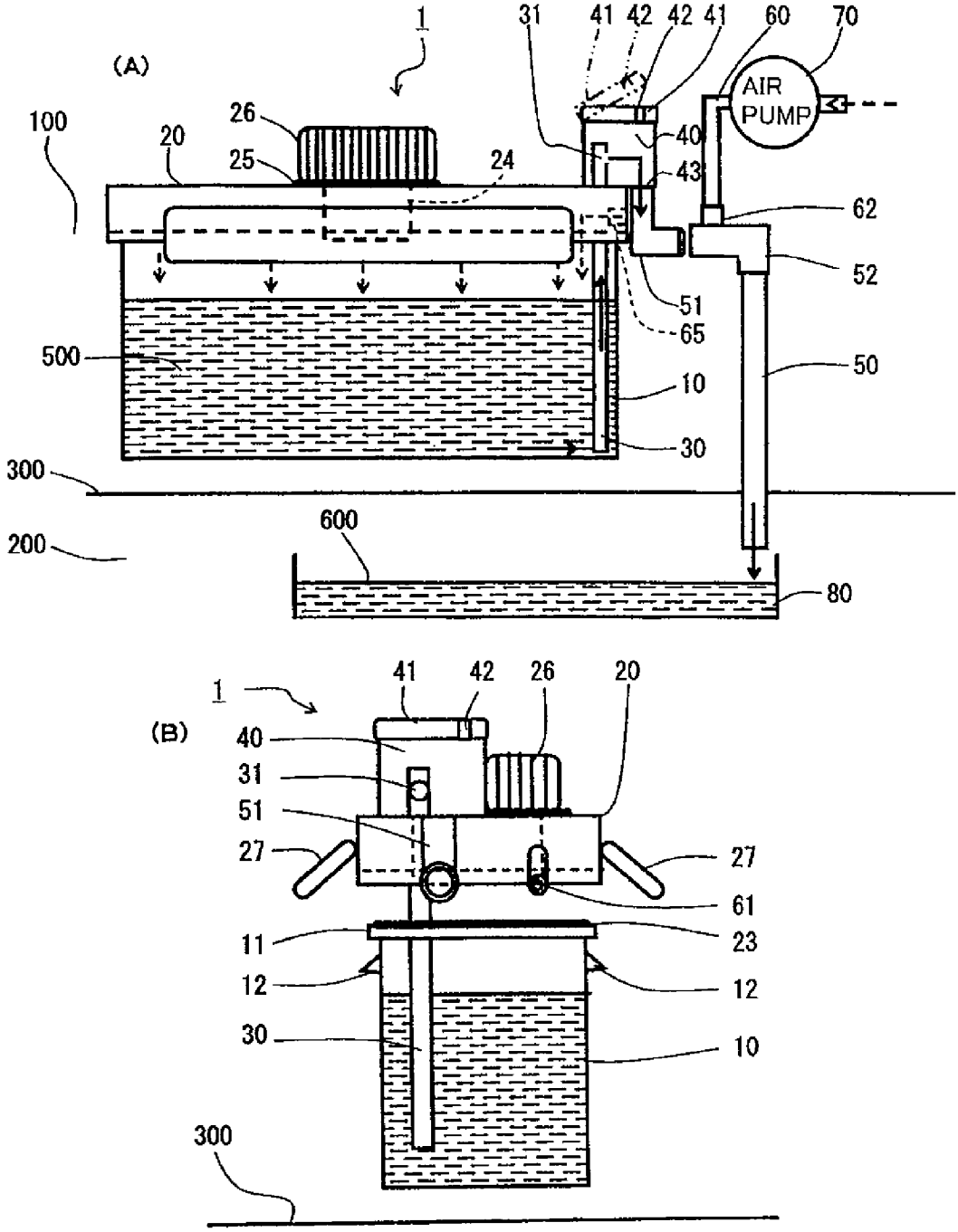
FIG. 1 shows an elevation view (A) and a side view (B) of a water supply apparatus for use in an automatic ice maker, according to one embodiment of the present invention, illustrating a schematic configuration thereof with the partial sectional views.
Figure 2:
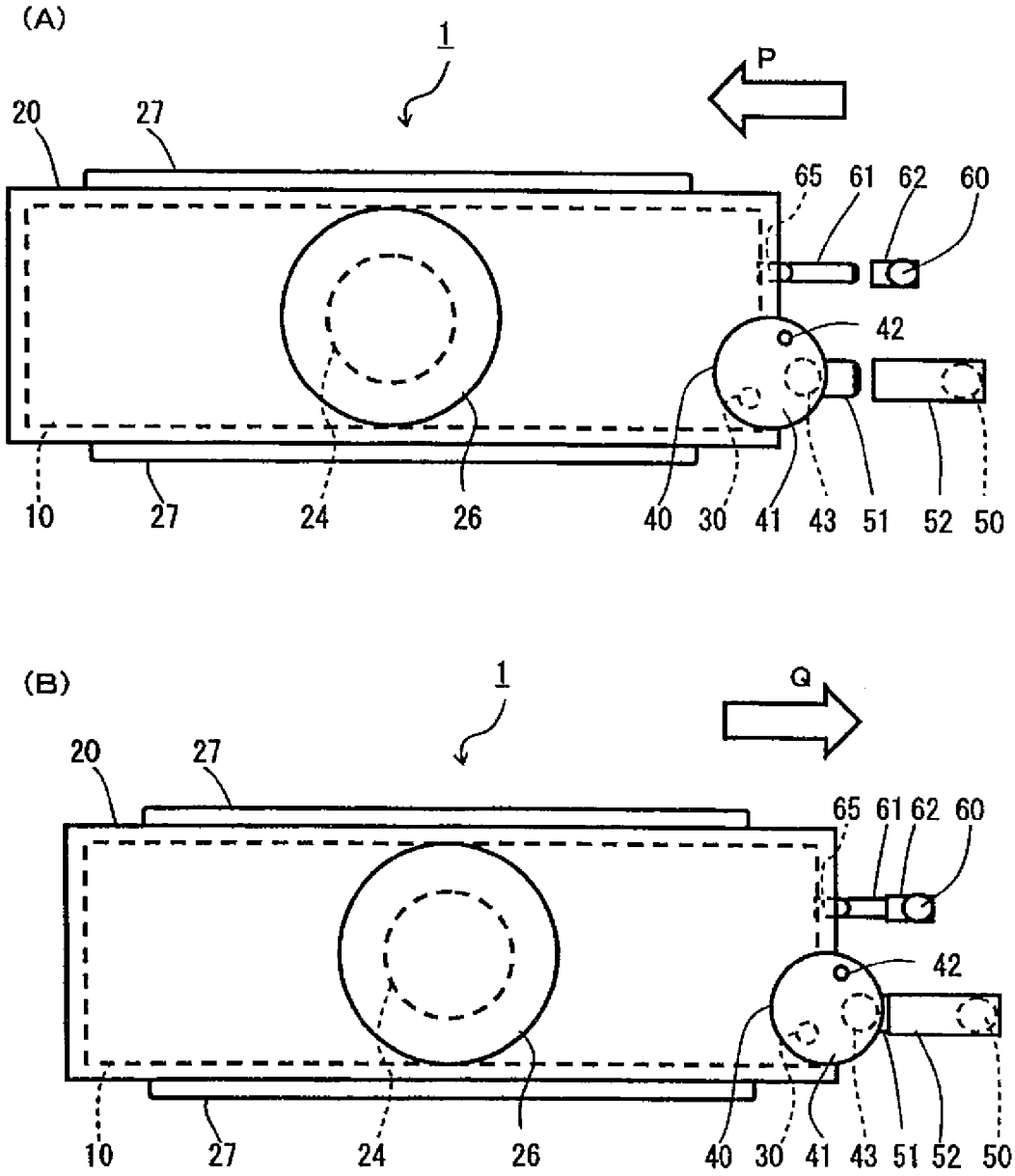
FIG. 2 shows plan views (A) and (B) illustrating motions in which a water supply tank in the water supply apparatus for use in the automatic ice maker, shown in FIG. 1, is attached and detached.

FIG. 1 shows an elevation view (A) and a side view (B) of a water supply apparatus for use in an automatic ice maker, according to one embodiment of the present invention, illustrating a schematic configuration thereof with the partial sectional views. In FIG. 1 (B), a part of the water supply apparatus for use in the automatic ice maker is illustrated in an exploded manner. FIG. 2 shows plan views (A) and (B) illustrating motions in which a water supply tank in the water supply apparatus for use in the automatic ice maker, shown in FIG. 1, is attached and detached.

As shown in FIG. 1, the water supply apparatus 1 for use in the automatic ice maker, which is incorporated into a refrigerator-freezer, according to the one embodiment of the present invention, is a water supply apparatus for use in an ice maker, which automatically supplies water 600 to be frozen into an ice tray 80 as indicated by solid line arrows. A space in the refrigerator-freezer is partitioned by a partition wall 300, and for example, a refrigerating room 100 is disposed above the partition wall 300 whereas a freezing room 200 is disposed below the partition wall 300. The water supply apparatus 1 for use in the automatic ice maker is disposed in the refrigerating room 100 of the refrigerator-freezer and the ice tray 80 is disposed in the freezing room 200 of the refrigerator-freezer.

The water supply apparatus 1 for use in the automatic ice maker comprises: a water supply tank 10 for containing water 500; an air pump 70; an air supply pipe 60 disposed between the air pump 70 and the water supply tank 10; a discharge pipe 30, constituting a water supply channel, disposed between the water supply tank 10 and the ice tray 80; a pressure adjusting chamber 40; and a water supply pipe 50.

The air supply pipe 60 feeds air from the air pump 70 into the water supply tank 10 as indicated by dashed line arrows shown in FIG. 1 (A). As shown in FIG. 1 and FIG. 2, the air supply pipe 60 includes an air supply pipe joint 61 as a first air supply pipe part disposed on a side of the water supply tank 10 and an air supply pipe joint 62 as a second air supply pipe part disposed on a side of the air pump 70. The air supply pipe joint 61 is inserted from a side of the water supply tank top cover 20 of the water supply tank 10, has an air inlet 65 inside the water supply tank top cover 20, and includes: a first horizontal portion extending in a substantially horizontal direction; a vertical portion coupled to this first horizontal portion and extending in a substantially vertical direction so as to be bent substantially downward; and a second horizontal portion coupled to this vertical portion, extending in a substantially horizontal direction, and connected to the air supply pipe joint 62. The air supply pipe joint 62 includes: a vertical portion connected to one end of the air supply pipe 60 connected to the air pump 70 and extending downward in a substantially vertical direction; and a horizontal portion coupled to this vertical portion, extending in a substantially horizontal direction, and connected to the air supply pipe joint 61. In FIG. 1 (A) and FIG. 2 (A), a state where the air supply pipe joint 61 and the air supply pipe joint 62 are separated from each other is shown. In FIG. 2 (B), a state where the air supply pipe joint 61 and the air supply pipe joint 62 are connected to each other is shown. By employing the above-described configuration, as indicated by the dashed line arrows shown in FIG. 1 (A), an air supply channel is formed such that the air flows from the air pump 70 via the air supply pipe 60, passes through the air supply pipe joint 62 and the air supply pipe joint 61, and is fed from the air inlet 65 into the water supply tank 10.

The discharge pipe 30, the pressure adjusting chamber 40, and the water supply pipe 50 which constitute the water supply channel disposed between the water supply tank 10 and the ice tray 80 discharge the water 500 from an inside of the water supply tank 10 to an outside of the water supply tank 10 and to supply the water 600 to the ice tray 80 as indicated by the solid line arrows in FIG. 1 (A). The water supply channel includes: the discharge pipe 30, which is inserted into the water supply tank 10, for causing the water in the water supply tank 10 to flow outside of the water supply tank 10; and the water supply pipe 50 for causing the water to flow into the ice tray 80. The pressure adjusting chamber 40 as a pressure adjusting part is disposed between a discharge outlet 31 as an outlet of the discharge pipe 30 and a water supply inlet 43 as an inlet of the water supply pipe 50. The discharge outlet 31 is formed on a side wall surface of the discharge pipe 30 inserted into the pressure adjusting chamber 40. In the control performed such that a given amount of water is supplied for a given period of time from the water supply tank 10 to the ice tray 80, a variation in a supplied water amount can be decreased in accordance with an increase in proximity of the discharge outlet 31 to a bottom surface of the pressure adjusting chamber 40.

The pressure adjusting chamber 40 is disposed at an upper portion of the water supply tank top cover 20 of the water supply tank 10. The discharge pipe 30 is disposed, as a pipe for causing the water in the water supply tank 10 to flow into the pressure adjusting chamber 40, so as to extend downward below the pressure adjusting chamber 40. The water supply pipe 50 is disposed below the pressure adjusting chamber 40 and above the ice tray 80 and is a pipe for causing the water in the pressure adjusting chamber 40 to flow into the ice tray 80. An inner diameter of the discharge pipe 30 is smaller than that of the water supply pipe 50. For example, a ratio of the inner diameter of the discharge pipe 30 to the inner diameter of the water supply pipe 50 is approximately 1 to 1.5.

The water supply pipe 50 includes: a water supply pipe joint 51 which is disposed as a first water supply pipe part on a side of the pressure adjusting chamber 40; and a water supply pipe joint 52 which is disposed as a second water supply pipe part on a side of the ice tray 80. The water supply pipe joint 51 is inserted from a bottom portion of the pressure adjusting chamber 40; has a water supply inlet 43 inside the pressure adjusting chamber 40; and includes a vertical portion extending downward in a substantially vertical direction and a horizontal portion coupled to this vertical portion and extending in a substantially horizontal direction so as to be bent in a substantially L-shaped manner. The water supply pipe joint 52 includes: a vertical portion connected to one end of the water supply pipe 50 whose opening of another end faces toward the ice tray 80 and extending in a substantially vertical direction; and a horizontal portion coupled to this vertical portion, extending in a substantially horizontal direction, and connected to the water supply pipe joint 51. In FIG. 1 (A) and FIG. 2 (A), a state where the water supply pipe joint 51 and the water supply pipe joint 52 are separated from each other is shown. In FIG. 2 (B), a state where the water supply pipe joint A51 and the water supply pipe joint 52 are connected to each other is shown. By employing the above-described configuration, as indicated by the solid line arrows in FIG. 1 (A), a water supply channel is formed such that the water 500 flows from the water supply tank 10, passes through the discharge pipe 30, flows out of the discharge outlet 31, enters the pressure adjusting chamber 40, flows out of the water supply inlet 43, passes via the water supply pipe joint 51 and the water supply pipe joint 52, passes through the water supply pipe 50, and is supplied into the ice tray 80.

On an upper portion of the pressure adjusting chamber 40, as a movable member which allows an upper portion of an internal space thereof to be opened and closed, a top lid 41 is mounted in an openable and closable manner as indicated by a solid line and a long dashed double-short dashed line. On the top lid 41 of the pressure adjusting chamber 40, a small vent 42 which is an opening is formed, as one example of a configuration which allows gas to circulate inside and outside of the pressure adjusting chamber 40. Note that if a configuration in which a clearance is provided between the top lid 41 and the pressure adjusting chamber 40 so as to circulate the gas inside and outside of the pressure adjusting chamber 40 is employed, the small vent 42 is not necessarily required.

The water supply tank 10 has a container, for containing the water 500, which has an opening on an upper portion thereof. As a covering member which is mountable in a state where the opening of the container of the water supply tank 10 is sealed, the water supply tank top cover 20 is mounted on the upper portion of the water supply tank 10 in an attachable and detachable manner.

Figure 3:
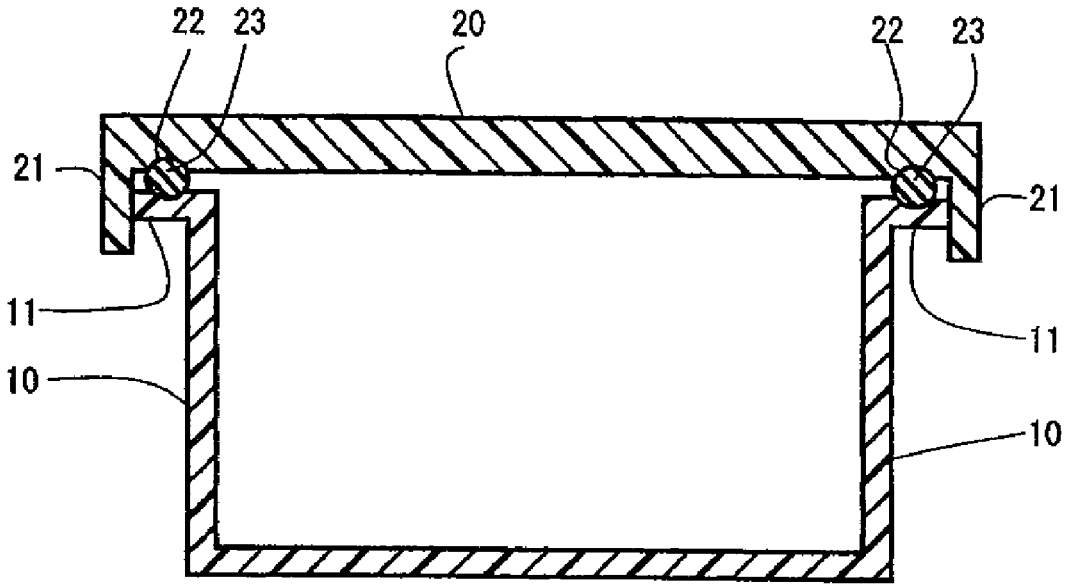
FIG. 3 shows a sectional view illustrating a schematic configuration of the water supply tank in the water supply apparatus for use in the automatic ice maker, according to the one embodiment of the present invention.

FIG. 3 shows a sectional view illustrating a schematic configuration of the water supply tank in the water supply apparatus for use in the automatic ice maker, according to the one embodiment of the present invention.

As shown in FIG. 1 (B) and FIG. 3, a flange portion 11 is formed on an upper portion of the container of the water supply tank 10. The water supply tank top cover 20 is provided such that a top cover circumferential wall portion 21 covers the flange portion 11 of the container and thereby, the water supply tank top cover 20 covers the opening of the container of the water supply tank 10. On circumferential ends of an inside of the water supply tank top cover 20, an O-ring-mounting groove 22 is formed. The water supply tank top cover 20 is attached such that the water supply tank top cover 20 covers the opening of the container of the water supply tank 10 in a state where an O-ring 23 is fitted in the O-ring-mounting groove 22. Fixing plates 27 are latched in top-cover fixing protruding portions 12 of the water supply tank 10, whereby the water supply tank top cover 20 is attached on the container of the water supply tank 10. At this time, the O-ring 23 fitted between the O-ring-mounting groove 22 and the flange portion 11 is disposed and the top cover circumferential wall portion 21 is disposed so as to cover a circumferential portion of the O-ring 23, thereby allowing a pressurized and sealed state of an inner space enclosed by the container of the water supply tank 10 and the water supply tank top cover 20.

The water 500 is fed to the container of the water supply tank 10 via a water supply inlet 24 provided on the water supply tank top cover 20. On an upper portion of the water supply inlet 24, a water supply inlet packing part 25 is provided. A water supply inlet top cap 26 is tightened to be screwed-in so as to cover the water supply inlet packing part 25, thereby allowing the water supply inlet 24 to be in a sealed state.

In addition, as shown in FIG. 1, the water supply pipe 50 mounted on a heat-insulating wall of the refrigerator-freezer is connected via the water supply pipe joint A51 and the water supply pipe joint 52 to the water supply tank top cover 20. The air supply pipe 60 mounted on the heat-insulating wall of the refrigerator-freezer is connected via the air supply pipe joint 61 and the air supply pipe joint 62 to the water supply tank top cover 20. The pressure adjusting chamber 40 is formed on the water supply tank top cover 20 in an integrated manner. On the other hand, the water supply pipe joint 51 and the water supply pipe joint 52 are attachable and detachable from each other in a horizontal direction and the air supply pipe joint 61 and the air supply pipe joint 62 are also attachable and detachable from each other in a horizontal direction. Accordingly, as shown in FIG. 1 (B), the water supply tank top cover 20, the pressure adjusting chamber 40, the water supply pipe joint 51, and the air supply pipe joint 61 are configured as an integrated member or an integrally formed member, and are separable in an integrated state from the container of the water supply tank 10, that is to say, attachable and detachable.

An operation of supplying the water from the water supply tank 10 to the ice tray 80, which is performed by the water supply apparatus 1 having the above-described configuration for use in the automatic ice maker, will be described.

First, the water 500 is fed via the water supply inlet 24 into the container of the water supply tank 10 and by tightening the water supply inlet top cap 26, is contained in a sealed state in the water supply tank 10. At this time, the water supply tank top cover 20 is fixed by latching the fixing plates 27 to the top-cover-fixing protruding portions 12 and thereby, is attached in a sealed state via the O-ring 23 to the container of the water supply tank 10.

Then, the air pump 70 is operated for a given period of time in accordance with a given amount of water to be supplied to the ice tray 80. This causes the air to be fed from the air pump 70 to the air supply pipe 60 as indicated by the dashed line arrows and then, to be fed via the air supply pipe joint 62 and the air supply pipe joint 61 from the air inlet 65 into the water supply tank 10. In the water supply tank 10, a pressure of the air is applied to the water 500 as indicated by the dashed line arrows.

The water 500 is pushed up by this pressure of the air from the inside of the water supply tank 10 via the discharge pipe 30, is fed to an outside of the water supply tank 10, and thereafter, is discharged from the discharge outlet 31; and the water discharged into the pressure adjusting chamber 40 is fed from the water supply inlet 43 via the water supply pipe joint 51 and the water supply pipe joint 52 into the water supply pipe 50 and is supplied into the ice tray 80. The water 600 stored in the ice tray 80 is cooled for a given period of time in the freezing room 200 and thereby, is frozen to be ice. The ice produced in the ice tray 80 is separated from the ice tray 80 by rotation or the like of the ice tray 80 and is contained in a container of an ice storage room or the like. In such a manner, when the ice tray 80 is emptied, the above-described operation of supplying the water is repeated.

As described above, in the water supply apparatus 1 of the present invention for use in the automatic ice maker, the air pump 70 feeds the air into the water supply tank 10 and thereby, the water is sent by the pressure of the air from the inside of the water supply tank 10 to the outside of the water supply tank 10 and supplied to the ice tray 80. Therefore, without causing the water to pass through the inside of the pump as a power source for the operation of supplying the water, the water can be supplied from the water supply tank 10 to the ice tray 80. Thus, the problem that the passage of the water makes the inside of the pump unclean can be solved. Accordingly, the water supply apparatus 1 of the present invention for use in the automatic ice maker is an apparatus which comprises a more hygienic water supply mechanism than the water supply mechanism comprising the conventional gear pump.

In addition, as described above, the water supply apparatus 1 of the present invention for use the automatic ice maker can supply the water from the water supply tank 10 to the ice tray 80 without passing the water through the inside of the pump, whereby accumulation of a foreign substance mixed in the water and dirt generated from a filter or the like in the inside of the pump is not caused. Thus, a trouble that the foreign substance or the like mixed in the water causes the pump, as a power source for the operation of supplying the water, not to work and thereby, the water cannot be supplied to the ice tray 80 does not occur. Accordingly, the problem that the foreign substance or the like mixed in the water causes the water supply to stop can be solved.

Furthermore, in the water supply apparatus 1 of the present invention for use in the automatic ice maker, the pressure adjusting chamber 40 for adjusting the pressure is mounted in the water supply channel disposed between the water supply tank 10 and the ice tray 80. Therefore, even if a positional relationship between a level of the water in the water supply tank 10 and a level of the water in the ice tray 80, which results when the air pump 70 feeds the water via the water supply channel from the inside of the water supply tank 10 to the outside of the water supply tank 10 through the pressure of the air fed to the inside of the water supply tank 10 and thereafter, the water supply using the air pump 70 is stopped, is a positional relationship which causes a siphon phenomenon, the pressure adjusting chamber 40 allows a part of the water supply channel to be adjusted to be at an atmospheric pressure (to be made open to an atmosphere). Therefore, an outflow of the water from the water supply tank 10 to the ice tray 80 due to the siphon phenomenon after the air pump 70 has been stopped can be easily prevented.

Specifically, when the air pump 70 feeds the air into the water supply tank 10 and thereby, sends the water 500 through the pressure of the air via the water supply channel from the inside of the water supply tank 10 to the outside of the water supply tank 10, and thereafter, the air pump 70 is stopped, the water in the water supply channel, particularly in the water supply pipe 50 for causing the water to flow into the ice tray 80, flows out, thereby generating a negative pressure in the water supply channel. This negative pressure is eliminated by an external air flowing in through the small vent 42 of the pressure adjusting chamber 40. Therefore, the flow of the water in the water supply channel is interrupted between a side of the water supply pipe 50 and a side of the discharge pipe 30, the water in the water supply pipe 50 flows out to the ice tray 80, and the water in the discharge pipe 30 flows back into the water supply tank 10. Accordingly, the simple configuration in which the small vent 42 allowing the gas to circulate between the inside and outside of the pressure adjusting chamber 40 is provided enables the prevention of the outflow of the water from the water supply tank 10 to the ice tray 80 due to the siphon phenomenon.

In addition, when the air pump 70 feeds the pressurized air into the water supply tank 10 and thereby, sends the water through the pressure of the air via the water supply channel from the inside of the water supply tank 10 to the outside of the water supply tank 10, the water 500 flows into the pressure adjusting chamber 40 above the water supply tank 10 through the discharge pipe 30. In this case, since the water supply pipe 50 is disposed below the pressure adjusting chamber 40 and above the ice tray 80, the water in the pressure adjusting chamber 40 is caused by gravitation to flow into the ice tray 80 through the water supply pipe 50. The water supply is performed in such a manner, whereby all the water which the air pump 70 causes to flow into the pressure adjusting chamber 40 via the discharge pipe 30 can be supplied via the water supply pipe 50 to the ice tray 80.

Furthermore, in this embodiment, the pressure adjusting chamber 40 includes the top lid 41 as a movable member for allowing the inside space thereof to be opened and closed, thereby allowing the inside of the pressure adjusting chamber 40 to be easily cleaned. In addition, the discharge pipe 30 and the water supply pipe joint 51 which constitutes a part of the water supply pipe 50 can be easily cleaned, thereby allowing the inside of the water supply channel to be hygienically maintained.

In this embodiment, the discharge pipe 30, the water supply pipe joint 51, and the pressure adjusting chamber 40 which constitute the water supply channel and the air supply pipe joint 61 which constitutes a part of the air supply pipe 60 for feeding the air from the air pump 70 as the power source to the water supply tank 10 are integrated into the water supply tank top cover 20 as a covering member of the water supply tank 10, thereby allowing the respective members constituting the water supply apparatus 1 for use in the automatic ice maker to be integrally handled. Thus, attachment and detachment of the water supply tank can be facilitated and the inside of the container of the water supply tank 10 can be easily cleaned with the water supply tank top cover 20 detached, thereby allowing the inside of the water supply tank 10 to be hygienically maintained.

In this embodiment, the air supply pipe 60 includes the air supply pipe joint 61 as the first air supply pipe part disposed on the side of the water supply tank and the air supply pipe joint 62 as the second air supply pipe part disposed on the side of the air pump 70, and the air supply pipe joint 61 and the air supply pipe joint 62 are attachable and detachable. Such a configuration allows the water supply tank 10 together with the air supply pipe joint 61 to be attached and detached, thereby enabling the water supply tank 10 to be easily attached to and detached from the air pump 70 as well as to and from, for example, a main body of the refrigerator-freezer or the like in which the air pump 70 is mounted.

In addition, in this embodiment, the water supply tank 10 includes the water supply pipe joint 51 as the first water supply pipe part disposed on the side of the pressure adjusting chamber 40 and the water supply pipe joint 52 as the second water supply pipe part disposed on the side of the ice tray 80, and the water supply pipe joint 51 and the water supply pipe joint 52 are attachable and detachable. Such a configuration allows the water supply tank 10 together with the water supply pipe joint 51 to be attached and detached, thereby enabling the water supply tank 10 to be easily attached to and detached from the ice tray 80 as well as to and from, for example, the main body of the refrigerator-freezer or the like in which the ice tray 80 is mounted.

Furthermore, in this embodiment, the water supply pipe joint 51 and the water supply pipe joint 52 are attachable and detachable in the horizontal direction. Therefore, when the water supply apparatus 1 of the present invention for use in the automatic ice maker is incorporated into the refrigerator-freezer or the like, the water supply tank 10 can be easily attached and detached by moving, in backward and forward directions, the water supply tank 10 to and from the ice tray 80 incorporated in the refrigerator-freezer or the like as well as to and from, for example, the main body of the refrigerator-freezer or the like in which the ice tray 80 is mounted. This allows further enhancement of usability of the water supply apparatus 1 for use in the automatic ice maker.

Moreover, in this embodiment, the air supply pipe 60 and the water supply pipe 50 are disposed in a neighboring manner. More specifically, it is preferable that the air supply pipe joint 61 constituting a part of the air supply pipe 60 and the water supply pipe joint 51 constituting a part of the water supply pipe 50 are disposed in a neighboring manner as shown in FIG. 1 (B) and centers of openings of the air supply pipe joint 61 and the water supply pipe joint 51, where the air supply pipe joint 61 and the water supply pipe joint 51 are connected to each other, are on the substantially same horizontal line. In addition, as shown in FIG. 2, it is preferable that the air supply pipe joint 61 and the water supply pipe joint 51 are disposed so as to extend along horizontal lines which are substantially in parallel with each other.

As described above, the air supply pipe 60 and the water supply pipe 50 are disposed in the neighboring manner to be attachable and detachable, thereby enabling the water supply tank 10 to be easily attached to and detached from the air pump 70 and the ice tray 80 as well as to and from, for example, the main body of the refrigerator-freezer or the like in which the air pump 70 and the ice tray 80 are mounted. Accordingly, the water supply tank 10 can be further easily attached and detached.

As indicated by a white arrow P shown in FIG. 2 (A), by moving the water supply tank 10 included in the water supply apparatus 1 for use in the automatic ice maker in a horizontal direction and in a direction in which the water supply tank 10 is moved away from the main body of the refrigerator-freezer or the like, for example, by moving the water supply tank 10 from a rear side toward a front side of the main body of the refrigerator-freezer or the like, the water supply tank 10 can be easily detached from the main body of the refrigerator-freezer or the like.

As indicated by a white arrow Q shown in FIG. 2 (B), by moving the water supply tank 10 included in the water supply apparatus 1 for use in the automatic ice maker in a horizontal direction and in a direction in which the water supply tank 10 approaches the main body of the refrigerator-freezer or the like, from a front side toward a rear side of the main body of the refrigerator-freezer or the like, the water supply tank 10 can be easily attached to the main body of the refrigerator-freezer or the like.

In this embodiment of the present invention, the air pump 70 feeds the air into the water supply tank 10, whereby the water is pushed up by the pressure of the air via the discharge pipe 30 into the pressure adjusting chamber 40 on the water supply tank 10. The water in the pressure adjusting chamber 40 is caused to flow via the water supply pipe 50 into the ice tray 80. Upon finishing the water supply, when the air pump 70 is stopped, an inflow of external air into the pressure adjusting chamber 40 causes the water in the pressure adjusting chamber 40 to separately flow out to a side of the water supply pipe 50 and a side of the discharge pipe 30; the water in the water supply pipe 50 is supplied to the ice tray 80; and the water in the discharge pipe 30 flows back and returns into the water supply tank 10. At this time, an amount of the water in the discharge pipe 30 flowing back to the water supply tank 10 decreases in accordance with a decrease in an inner diameter of the discharge pipe 30. Accordingly, the control is performed such that the given amount of the water is supplied from the water supply tank 10 to the ice tray 80 by operating the air pump 70 for the given period of time, thereby allowing prevention of a large variation in the supplied water, which is attributed to the water supply channel and particularly, to the discharge pipe 30. In other words, the water supply channel in the water supply apparatus 1 of the present invention for use in the automatic ice maker serves so as to reduce the variation in the amount of the supplied water in the control performed such that the given amount of the water is supplied from the water supply tank 10 to the ice tray 80 for the given period of time.

In addition, because the inner diameter of the discharge pipe 30 is smaller than that of the water supply pipe 50, that is to say, the inner diameter of the water supply pipe 50 is larger than that of the discharge pipe 30, an inflow of the air via the water supply pipe 50 into the pressure adjusting chamber 40 relatively increases. Therefore, an outflow of the water from the water supply tank 10 to the ice tray 80 due to the siphon phenomenon can be prevented also by suction of the external air through the water supply pipe 50.

Figure 4:
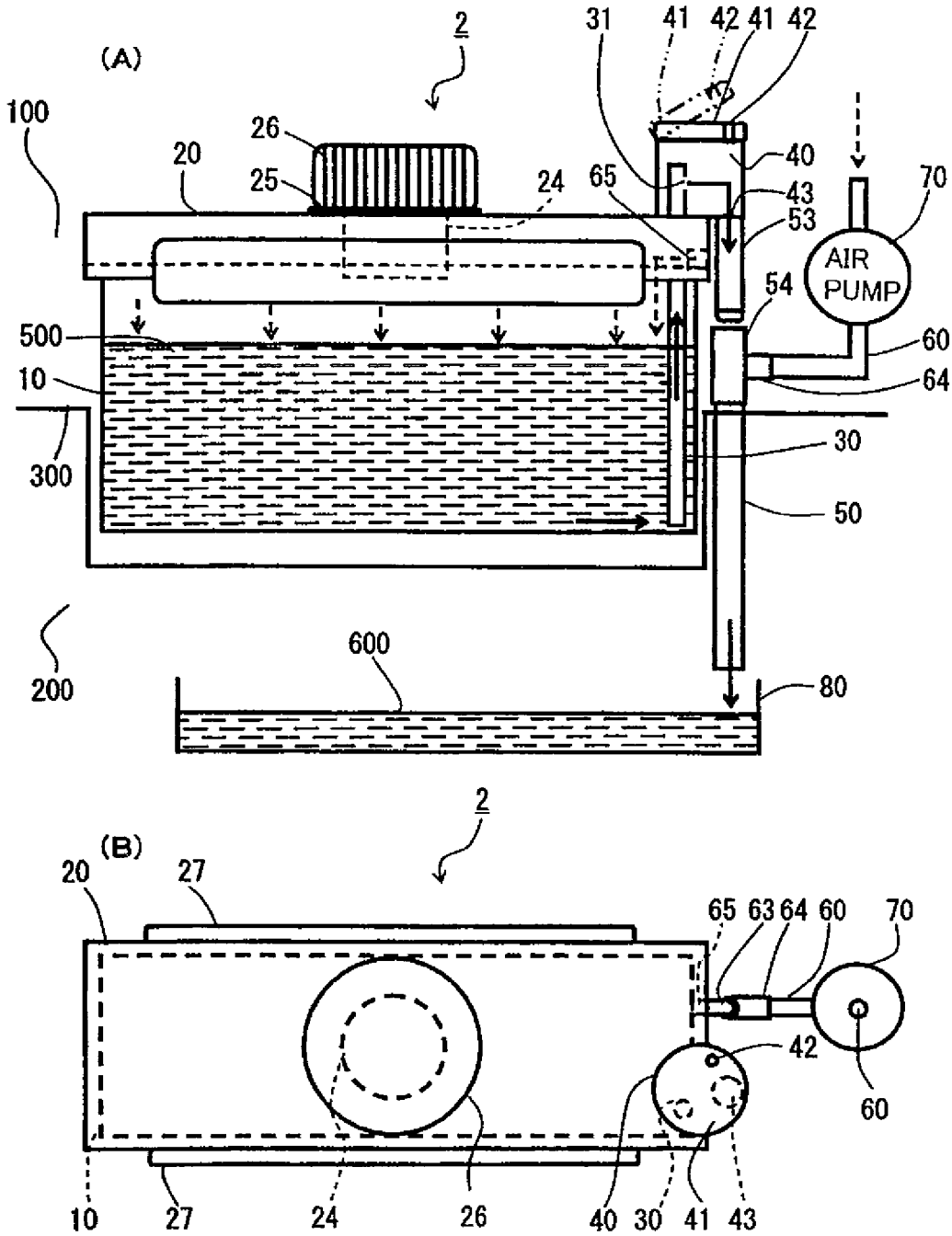
FIG. 4 shows an elevation view (A) and a plan view (B) of a water supply apparatus for use in an automatic ice maker, according to another embodiment of the present invention, illustrating a schematic configuration thereof with the partial sectional views.
Figure 5:
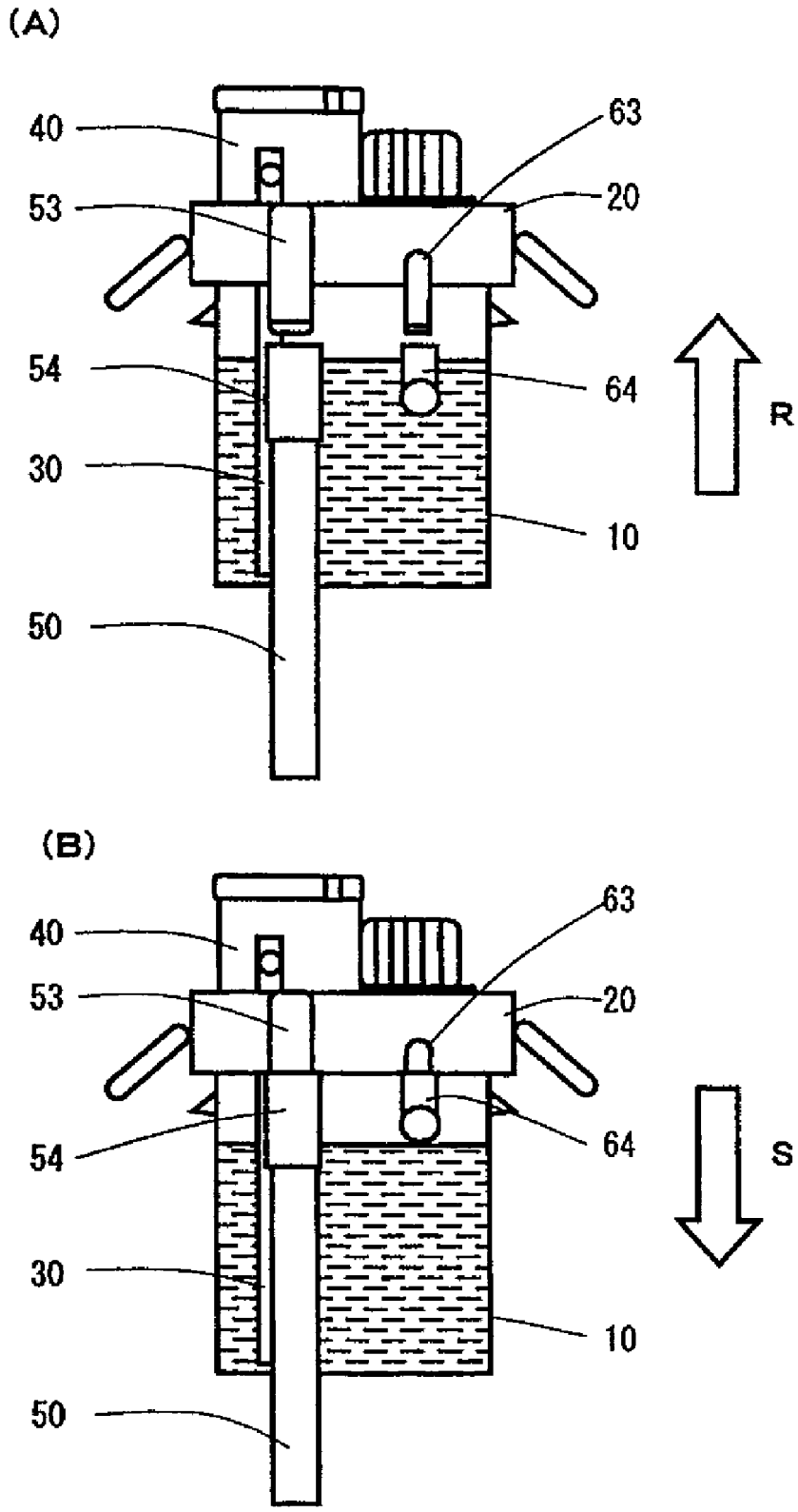
FIG. 5 shows side views (A) and (B) illustrating motions in which a water supply tank in the water supply apparatus for use in the automatic ice maker, shown in FIG. 4, is attached and detached.

FIG. 4 shows an elevation view (A) and a plan view (B) of a water supply apparatus for use in an automatic ice maker, according to another embodiment of the present invention, illustrating a schematic configuration thereof with the partial sectional views. FIG. 5 shows side views (A) and (B) illustrating motions in which a water supply tank in the water supply apparatus for use in the automatic ice maker, shown in FIG. 4, is attached and detached.

The water supply apparatus 2 for use in the automatic ice maker, shown in FIG. 4, is different from the water supply apparatus 1 for use in the automatic ice maker, shown in FIG. 1, in a configuration of a pipe joint constituting a part of the water supply pipe 50 and a pipe joint constituting a part of the air supply pipe 60. On the other respects, the water supply apparatus 2 for use in the automatic ice maker, shown in FIG. 4, has a configuration similar to that of the water supply apparatus 1 for use in the automatic ice maker, shown in FIG. 1.

As shown in FIG. 4 and FIG. 5, the air supply pipe 60 includes an air supply pipe joint 63 as a first air supply pipe part disposed on a side of the water supply tank 10 and an air supply pipe joint 64 as a second air supply pipe part disposed on a side of the air pump 70. The air supply pipe joint 63 is coupled to a side of the water supply tank top cover 20 of the water supply tank 10, has an air inlet 65 inside the water supply tank top cover 20, and includes: a horizontal portion extending in a substantially horizontal direction; and a vertical portion coupled to this horizontal portion, extending in a substantially vertical direction so as to be bent substantially downward, and coupled to the air supply pipe joint 64. The air supply pipe joint 64 includes: a horizontal portion connected to one end of the air supply pipe 60 connected to the air pump 70 and extending downward in a substantially horizontal direction; and a vertical portion coupled to this horizontal portion, extending in a substantially vertical direction so as to be bent upward, and connected to the air supply pipe joint 63. In FIG. 4 (A) and FIG. 5 (A), a state where the air supply pipe joint 63 and the air supply pipe joint 64 are separated from each other is shown. In FIG. 5 (B), a state where the air supply pipe joint 63 and the air supply pipe joint 64 are connected to each other is shown. By employing the above-described configuration, as indicated by dashed line arrows shown in FIG. 4 (A), an air supply channel is formed such that the air flows from the air pump 70 via the air supply pipe 60, passes through the air supply pipe joint 63 and the air supply pipe joint 64, and is fed from the air inlet 65 into the water supply tank 10.

As shown in FIG. 4 and FIG. 5, the water supply pipe 50 includes: a water supply pipe joint 53 which is disposed as a first water supply pipe part on a side of the pressure adjusting chamber 40; and a water supply pipe joint 54 which is disposed as a second water supply pipe part on a side of the ice tray 80. The water supply pipe joint 53 is coupled to a bottom portion of the pressure adjusting chamber 40; has a water supply inlet 43 inside the pressure adjusting chamber 40; and includes a vertical portion extending downward in a substantially vertical direction. The water supply pipe joint 54 includes: a vertical portion connected to one end of the water supply pipe 50, whose opening of another end faces toward the ice tray 80, and extending in a substantially vertical direction. In FIG. 4 (A) and FIG. 5 (A), a state where the water supply pipe joint 53 and the water supply pipe joint 54 are separated from each other is shown. In FIG. 5 (B), a state where the water supply pipe joint 353 and the water supply pipe joint 54 are connected to each other is shown. By employing the above-described configuration, as indicated by solid line arrows in FIG. 4 (A), a water supply channel is formed such that the water 500 flows from the water supply tank 10, passes through the discharge pipe 30, flows out of the discharge outlet 31, enters the pressure adjusting chamber 40, flows out of the water supply inlet 43, passes via the water supply pipe joint 53 and the water supply pipe joint 54, passes through the water supply pipe 50, and is supplied into the ice tray 80.

In this embodiment, the water supply pipe joint 53 and the water supply pipe joint 54 are attachable and detachable in the vertical direction. Therefore, when the water supply apparatus 2 of the present invention for use in the automatic ice maker is incorporated into the refrigerator-freezer or the like, the water supply tank 10 can be easily attached and detached by moving, in upward and downward directions, the water supply tank 10 to and from the ice tray 80 incorporated in the refrigerator-freezer or the like as well as to and from, for example, the main body of the refrigerator-freezer or the like in which the ice tray 80 is mounted. This allows enhancement of maintainability of the water supply apparatus 2 for use in the automatic ice maker.

In addition, in this embodiment, the air supply pipe 60 and the water supply pipe 50 are disposed in a neighboring manner. More specifically, it is preferable that the air supply pipe joint 63 constituting a part of the air supply pipe 60 and the water supply pipe joint 53 constituting a part of the water supply pipe 50 are disposed in a neighboring manner as shown in FIG. 5 (A) and centers of openings of the air supply pipe joint 63 and the water supply pipe joint 53, where the air supply pipe joint 63 and the water supply pipe joint 53 are connected to each other, are on the substantially same horizontal line. In addition, as shown in FIG. 5 (A), it is preferable that the air supply pipe joint 63 and the water supply pipe joint 53 are disposed so as to extend along vertical lines which are substantially in parallel with each other.

As described above, since the air supply pipe 60 and the water supply pipe 50 are disposed in the neighboring manner to be attachable and detachable, thereby enabling the water supply tank 10 to be easily attached to and detached from the air pump 70 and the ice tray 80 as well as to and from, for example, the main body of the refrigerator-freezer or the like in which the air pump 70 and the ice tray 80 are mounted. Accordingly, the water supply tank 10 can be further easily attached and detached.

As indicated by a white arrow R shown in FIG. 5 (A), by moving upward in a vertical direction the water supply tank 10 included in the water supply apparatus 2 for use in the automatic ice maker, that is to say, by moving the water supply tank 10 from a lower side toward an upper side of the main body of the refrigerator-freezer or the like, the water supply tank 10 can be easily detached from the main body of the refrigerator-freezer or the like.

As indicated by a white arrow S shown in FIG. 5 (B), by moving downward in a vertical direction the water supply tank 10 included in the water supply apparatus 2 for use in the automatic ice maker, that is to say, by moving the water supply tank 10 from an upper side toward a lower side of the main body of the refrigerator-freezer or the like, the water supply tank 10 can be easily attached to the main body of the refrigerator-freezer or the like.

As to the other respects than the above-described respects, the water supply apparatus 2 for use in the automatic ice maker, shown in FIG. 4, enables achievement of the effects similar to those of the above-described water supply apparatus 1 for use in the automatic ice maker.

Figure 6:
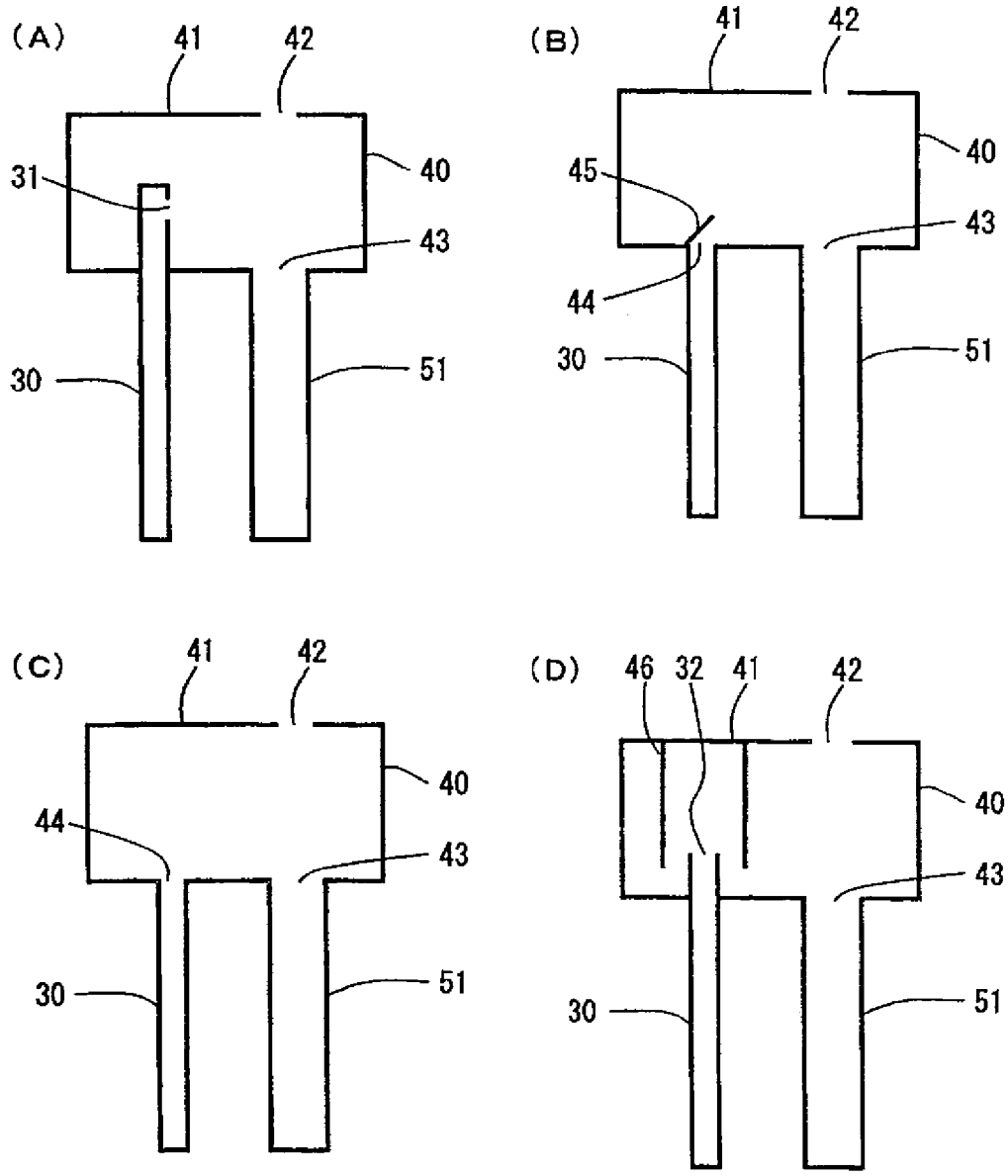
FIG. 6 shows sectional views (A), (B), (C), and (D) illustrating schematic configurations of pressure adjusting parts in water supply apparatuses for use in automatic ice makers according to a variety of embodiments of the present invention.

FIG. 6 shows sectional views (A), (B), (C), and (D) illustrating schematic configurations of pressure adjusting parts in water supply apparatuses for use in automatic ice makers according to a variety of embodiments of the present invention.

As shown in FIG. 6 (A), as described in the one embodiment of the present invention shown in FIG. 1, a small vent 42 is formed on a top lid 41 of a pressure adjusting chamber 40 and in order to prevent a foreign substance or the like from entering an inside of a discharge pipe 30 and to hygienically maintain the inside of the discharge pipe 30, a discharge outlet 31 is formed on a side wall of the discharge pipe 30.

Unlike in the one embodiment of the present invention shown in FIG. 1, as shown in FIG. 6 (B), a discharge outlet 44 may be formed at an opening where the discharge pipe 30 and the pressure adjusting chamber 40 are connected and a non-return valve 45 may be provided at the discharge outlet 44.

In addition, as shown in FIG. 6 (C), a discharge outlet 44 may be merely formed at an opening where the discharge pipe 30 and the pressure adjusting chamber 40 are connected.

Furthermore, as shown in FIG. 6 (D), with a discharge pipe 30 inserted into a pressure adjusting chamber 40, an annular wall 46 may be formed so as to surround an outer circumferential wall of the discharge pipe 30 around a discharge outlet 32 and to extend downward toward an internal space of the pressure adjusting chamber 40 from a top lid 41. This enables preventing a foreign substance or the like from entering an inside of the discharge pipe 30 from the discharge outlet 32.

Figure 7:
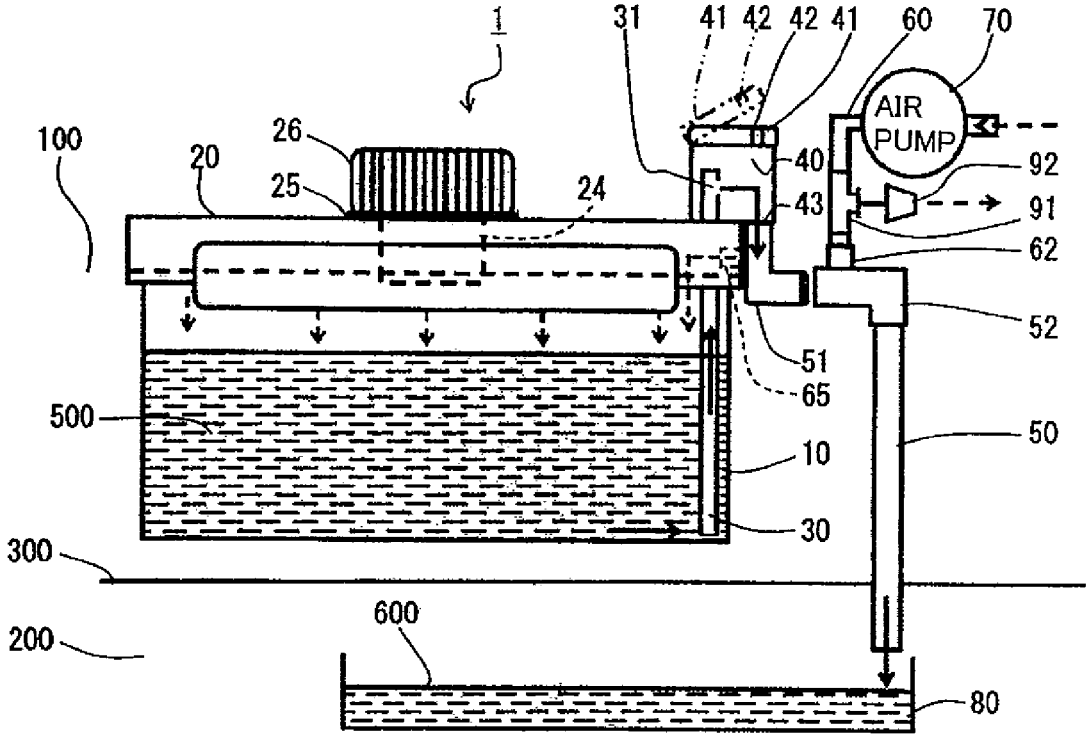
FIG. 7 shows an elevation view of a water supply apparatus for use in an automatic ice maker according to further another embodiment of the present invention, illustrating a schematic configuration thereof with the partial sectional views.

FIG. 7 shows an elevation view of a water supply apparatus for use in an automatic ice maker according to further another embodiment of the present invention, illustrating a schematic configuration thereof with the partial sectional views.

The water supply apparatus 1 for use in the automatic ice maker, shown in FIG. 7, is different from the water supply apparatus 1 for use in the automatic ice maker, shown in FIG. 1, in that a leak part 91 and a clogging prevention part 92 are provided on an air supply pipe 60. As to the other respects than the above-mentioned respect, the water supply apparatus 2 for use in the automatic ice maker, shown in FIG. 7, has a configuration similar to that of the water supply apparatus 1 for use in the automatic ice maker, shown in FIG. 1.

As shown in FIG. 7, the leak part 91 is provided on the air supply pipe 60 disposed in the vicinity of a discharge side of an air pump 70. At an opening of the leak part 91, the clogging prevention part 92 is provided.

Specifically, the leak part 91 is provided on the discharge side in the vicinity of the air pump 70 so as to branch in a T-shaped manner and is a capillary tubule, having an inner diameter of approximately 0.3 mm, which is invariably open. When the air pump 70 is driven, air is fed into a water supply tank 10 while the leak part 91 is leaking a part of the discharged air from an opening thereof. An amount of the air to be leaked varies depending on performance of the air pump 70. However, if the amount of the air to be leaked is excessively large, a large-sized pump is uselessly required in order to increase a pressure, thereby leading to an inefficiency. Therefore, it is preferable that the amount of the air to be leaked is approximately less than or equal to ¼ of an amount of a main air flow. In addition, a small hole may be provided instead of the capillary tubule.

By employing the above-described configuration, the air is fed into the water supply tank 10 while upon driving the air pump 70, the discharged air is partially being leaked, whereby the pressure in the water supply tank 10 is raised and the water in the water supply tank 10 is supplied to the ice tray 80. Upon stopping the air pump 70, after the stoppage, the air promptly escapes from the leak part 91 and the pressure in the air supply channel becomes substantially equal to a pressure of external air (in a refrigerator). Therefore, when the air pump 70 is driven next, feeding the air can be started through applying the substantially same pressure as the pressure applied upon previously driving the air pump 70, thereby allowing the supplied water amount to be stabilized. Further, even if the pressure in the water supply tank 10 changes due to a change in a water temperature, which may be caused by supplying the water into the water supply tank 10, or due to an increase in an ambient temperature around the water supply tank 10, which may result, for example, when the door of the refrigerating room is left open for a long time, the leak part 91 can promptly make the pressure in the water supply tank 10 substantially equal to the pressure in the refrigerator, thereby allowing a substantially constant amount of water to be supplied to the ice tray 80 with no influence exerted by a secondary pressure change.

Furthermore, at the opening of the leak part 91, the clogging prevention part 92 like, for example, a filter is provided, thereby allowing prevention of clogging of a leak hole.

Note that if the leak part and the clogging prevention part are provided on the water supply tank top cover 20, the same effect as the above-described effect can be attained. However, when the leak part and the clogging prevention part are provided on the water supply tank top cover 20, there is a concern that the filter for preventing the clogging may be dampened when the leak part is temporarily closed due to condensation, water adhesion or the like in the water supply tank 10, the pressure changes immediately after driving the air pump 70, and the water is gushed to the clogging prevention part. Therefore, it is preferable that the leak part 91 and the clogging prevention part 92 are provided at a position where the leak part 91 and the clogging prevention part 92 are not subject to any influence exerted by the water in the vicinity of the air pump 70.

Figure 8:
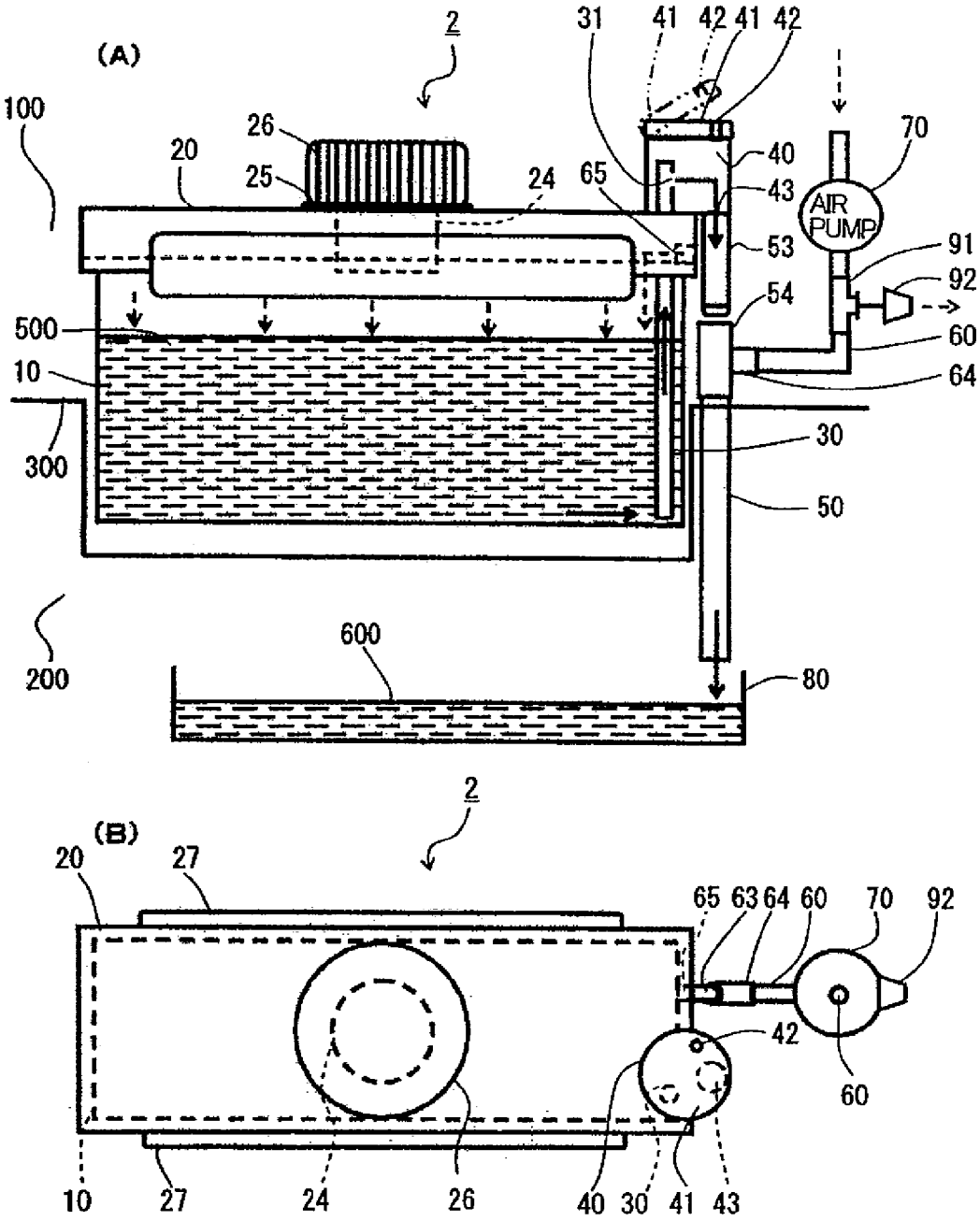
FIG. 8 shows an elevation view (A) and a plan view (B) of a water supply apparatus for use in an automatic ice maker, according to still another embodiment of the present invention, illustrating a schematic configuration thereof with the partial sectional views.

FIG. 8 shows an elevation view (A) and a plan view (B) of a water supply apparatus for use in an automatic ice maker, according to still another embodiment of the present invention, illustrating a schematic configuration thereof with the partial sectional views.

The water supply apparatus 2 for use in the automatic ice maker, shown in FIG. 8, is different from the water supply apparatus 2 for use in the automatic ice maker, shown in FIG. 4, in that the above-described leak part 91 and clogging prevention part 92 are provided on an air supply pipe 60. As to the other respects than the above-mentioned respect, the water supply apparatus 2 for use in the automatic ice maker, shown in FIG. 8, has a configuration similar to that of the water supply apparatus 2 for use in the automatic ice maker, shown in FIG. 4.

Also in the water supply apparatus 2 for use in the automatic ice maker, shown in FIG. 8, effect can be attained as similarly to in the water supply apparatus 1 for use in the automatic ice maker, shown in FIG. 7.

Note that at least if the pressure in the air supply channel including the water supply tank can be made substantially equal to the pressure of external air (in a refrigerator), the leak part may be provided anywhere in the air supply channel.

The described embodiments are to be considered in all respects only as illustrative and not restrictive. It is intended that the scope of the invention is, therefore, indicated by the appended claims rather than the foregoing descriptions of the embodiments and that all modifications and variations coming within the meaning and equivalency range of the appended claims are embraced within their scope.

INDUSTRIAL APPLICABILITY

By incorporating a water supply apparatus of the present invention for use in an ice maker into a household refrigerator-freezer or the like, a further hygienic water supply mechanism can be provided; a problem that supplying water is stopped due to a foreign substance or the like mixed in the water can be solved; an outflow of the water from a water supply tank to an ice tray due to a siphon phenomenon during a water supply for making ice after stopping an air pump can be easily prevented. Even though a water supply method which requires airtightness is employed in the water supply apparatus of the present invention for use in the ice maker, stabilization of a supplied water amount is enabled also with no influence exerted by a change in a pressure in the water supply tank, which is caused by a change in a water temperature and a change in an ambient temperature.

The invention claimed is:

1. A water supply apparatus for use in an ice maker, operable to supply water to be frozen to an ice tray, comprising:

a water supply tank for containing water;

an air pump for feeding air into the water supply tank;

an air supply pipe, disposed between the air pump and the water supply tank, for feeding the air from the air pump into the water supply tank; and a water supply channel, disposed between the water supply tank and the ice tray, for supplying the water to the ice tray by using the air pump which feeds the air into the water supply tank through a pressure of the air sending the water from an inside of the water supply tank to an outside of the water supply tank, wherein the water supply channel includes a pressure adjusting part, directly and integrally attached to the water supply tank, for adjusting a pressure in the water supply channel and a water supply pipe for causing the water to flow into the ice tray, wherein the water supply pipe includes a first water supply pipe part disposed on a side of the pressure adjusting part and a second water supply pipe part disposed on a side of the ice tray; the first water supply pipe part and the second water supply pipe part are attachable and detachable; the air supply pipe includes a first air supply pipe part disposed on a side of the water supply tank and a second air supply pipe part disposed on a side of the air pump; and the first air supply pipe part and the second air supply pipe part are attachable and detachable, wherein the water supply channel includes a discharge pipe for causing the water in the water supply tank to flow outside of the water supply tank, and wherein the pressure adjusting part is attached to the water supply tank and disposed between an outlet of the discharge pipe and an inlet of the water supply pipe and has a structure in which circulation of gas inside and outside of the pressure adjusting part is enabled.

2. The water supply apparatus for use in the ice maker, according to claim 1, wherein the pressure adjusting part is disposed above the water supply tank; the discharge pipe is a pipe for causing the water in the water supply tank to flow into the pressure adjusting part; and the water supply pipe is disposed below the pressure adjusting part and above the ice tray and is a pipe for causing the water in the pressure adjusting part to flow into the ice tray.

3. The water supply apparatus for use in the ice maker, according to claim 2, wherein the pressure adjusting part includes a movable member for allowing an upper portion of an inside space thereof to be opened and closed.

4. The water supply apparatus for use in the ice maker, according to claim 1, wherein the water supply tank includes a container, having an opening on an upper portion thereof, for containing the water and a covering member which is attachable such that the opening of the container is in a sealed state, and wherein the first water supply pipe part, the discharge pipe, the first air supply pipe part, and the pressure adjusting part are provided on the covering member.

5. The water supply apparatus for use in the ice maker, according to claim 1, wherein the first water supply pipe part and the second water supply pipe part are attachable and detachable in a horizontal direction.

6. The water supply apparatus for use in the ice maker, according to claim 1, wherein the first water supply pipe part and the second water supply pipe part are attachable and detachable in an upward-and-downward direction.

7. The water supply apparatus for use in the ice maker, according to claim 1, wherein the first water supply pipe part and the first air supply pipe part are disposed in a neighboring manner.

8. The water supply apparatus for use in the ice maker, according to claim 1, wherein an inner diameter of the discharge pipe is smaller than an inner diameter of the water supply pipe.

9. The water supply apparatus for use in the ice maker, according to claim 1, wherein a leak part for leaking the air to an outside is provided on one of the air supply pipe, the water supply tank, and the air pump.

10. The water supply apparatus for use in the ice maker, according to claim 9, wherein a clogging prevention part is provided at an opening of the leak part.

* * * * *